US007134846B2

(12) United States Patent
Djordjevic

(10) Patent No.: US 7,134,846 B2
(45) Date of Patent: Nov. 14, 2006

(54) RADIAL PISTON PUMP WITH ECCENTRICALLY DRIVEN ROLLING ACTUATION RING

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 209 days.

(21) Appl. No.: 10/857,313

(22) Filed: May 28, 2004

(65) Prior Publication Data

US 2005/0265867 A1 Dec. 1, 2005

(51) Int. Cl.
*F04B 1/04* (2006.01)

(52) U.S. Cl. ..... 417/273; 417/521; 417/440; 417/307

(58) Field of Classification Search ..... 417/273, 417/521, 440, 307; 92/72, 132, 130 C, 130 R
See application file for complete search history.

(56) References Cited

U.S. PATENT DOCUMENTS

| | | | | |
|---|---|---|---|---|
| 3,908,517 | A | 9/1975 | Wenbourne | |
| 4,386,587 | A | 6/1983 | Simko | |
| 4,576,128 | A | 3/1986 | Kenichi | |
| 4,803,889 | A | 2/1989 | Harris | |
| 5,067,881 | A | 11/1991 | Maehara | |
| 5,145,339 | A | 9/1992 | Lehrke et al. | |
| 5,690,065 | A | 11/1997 | Janse van Vuuren | |
| 5,826,551 | A | 10/1998 | Janse van Vuuren | |
| 5,842,405 | A * | 12/1998 | Schaefer et al. | 92/84 |
| 5,897,302 | A * | 4/1999 | Siegel et al. | 417/521 |
| 6,109,894 | A * | 8/2000 | Chatelain | 417/429 |
| 6,231,468 | B1 | 5/2001 | Bajulaz | |
| 6,257,190 | B1 | 7/2001 | Linebarger | |
| 6,446,604 | B1 | 9/2002 | Guentert et al. | |
| 6,457,957 | B1 * | 10/2002 | Bauer et al. | 417/562 |
| 6,991,438 | B1 * | 1/2006 | Blessing et al. | 417/273 |

* cited by examiner

*Primary Examiner*—Anthony D. Stashick
*Assistant Examiner*—Vikansha Dwivedi
(74) *Attorney, Agent, or Firm*—Alix, Yale & Ristas, LLP

(57) ABSTRACT

An hydraulic head features two or three individual radial pumping pistons and associated pumping chambers, annularly spaced around a cavity in the head where an eccentric drive member with associated outer rolling actuation ring are situated, whereby a rolling interaction is provided between the actuating ring and the inner ends of the pistons for intermittent actuation, and a sliding interaction is provided between the actuation ring and the drive member. The respective inlet and outlet valve trains are also situated in the head, and the head is attachable to an application and/or customer specific mounting plate. The outside diameter of the rolling element is barrel shaped, to compensate for any misalignment of the pistons relative to the drive shaft due, for example, to either tolerance stack up or deflection.

19 Claims, 7 Drawing Sheets

RADIAL PISTON PUMP WITH ECCENTRICALLY DRIVEN ROLLING ACTUATION RING

BACKGROUND OF THE INVENTION

The present invention relates to diesel fuel pumps, and more particularly, to radial piston pumps for supplying high-pressure diesel fuel to common rail fuel injection systems.

Diesel common rail systems have now become the state of the art in the diesel engine industry and furthermore, they are currently entering into their second and sometimes even third generation. Attention is presently focused on realizing further improvements in fuel economy and complying with more restrictive emission laws. In pursuit of these goals, engine manufacturers are more willing to select the most effective component for each part of the overall fuel injection system, from a variety of suppliers, rather than continuing to rely on only a single system integrator.

As a consequence, the present inventor has been motivated to improve upon the basic concepts of a two or three radial piston high-pressure fuel supply pump, to arrive at a highly effective and universally adaptable pump that can be incorporated into a wide variety of common rail injection systems.

SUMMARY OF INVENTION

According to the invention, an hydraulic head features two or three individual radial pumping pistons and associated pumping chambers, annularly spaced around a cavity in the head where an eccentric drive member with associated outer rolling actuation ring are situated, whereby a rolling interaction is provided between the actuating ring and the inner ends of the pistons for intermittent actuation, and a sliding interaction is provided between the actuation ring and the drive member. The respective inlet and outlet valve trains are also situated in the head, and the head is attachable to an application and/or customer specific mounting plate.

The drive member is rigidly carried by a drive shaft which is supported by two bushings, one located in the mounting plate and the other in the hydraulic head. Depending on actual pumping force level and the rated speed, these bushings can be executed as either journal bushings or needle bearings. In the case of journal bushings it is advantageous to make these force-lubricated by branching of a portion of pressurized fuel from the feed circuit.

The actuation force for each pumping event is sequentially transferred from the eccentric to the pistons by the rolling actuation ring, which is supported on the drive member by either a force-lubricated bushing or by a needle bearing, located approximately in the middle of the shaft. The outside diameter of this rolling element is barrel shaped, to compensate for any misalignment of the pistons relative to the drive shaft due, for example, to either tolerance stack up or deflection.

Preferably, a semi rigid yoke connects the pistons and forces the inactive (not pumping) piston toward the bottom dead center, while the other piston is pumping, by means of a so-called desmodromic dynamic connection. The rigidity of the yoke must be adequate to minimize deflection (even at maximum vacuum at zero output conditions), as any separation and subsequent impact at the start of pumping would have a detrimental effect on life expectancy. At the same time the contact force between the pistons and the outer diameter of the rolling element should be kept as low as possible, to minimize wear and heat generation during the intermittent sliding, which occurs only during the charging cycle.

In one embodiment, the pump has only two piston bores and associated two pistons, each piston bore has a centerline that intersects the actuation ring but is offset from the drive axis, and the piston bore centerlines are parallel to each other but offset from each other as viewed along the drive axis.

In another embodiment, the pump has three substantially equiangularly spaced apart piston bores and associated three pistons and each piston bore has a centerline that intersects the actuation ring but is offset from the drive axis as viewed along the drive axis.

Preferably, each piston is situated in its respective piston bore not only for free reciprocating movement along the bore axis during charging and discharging phases of operation, but also for free rotation about the piston axis to accommodate any unbalanced forces acting at the interface between the radially inner end of the piston (or its associated shoe) and the actuating ring.

Pump output is preferably controlled by inlet metering with a proportional solenoid valve, but other commonly available control techniques can be used provided, however, that the opening pressure of the inlet check valves should be high enough to prevent uncontrolled and undesired charging by vacuum created by the pistons during the suction stroke. In order to improve control resolution and by that to insure full controllability at even the lowest speeds the control solenoid valve should be either of flow proportional type or pressure proportional type combined with a variable flow area orifice.

The main advantages of the invention compared to the currently available competitive pumps include:

- Capability to generate high pumping pressure up to 2000 bar.
- Absence of low speed high force sliding interface between the piston and the rolling element. At partial output, which is typical situation under normal operating conditions, relative sliding takes place only during the charging events and because of that at safely low force level. Also during the rare operation in 100% output mode (cold starting) the relative sliding takes place at reduced force level because of unavoidable overlapping of pressurizing and depressurizing strokes.
- Absence of a preferred wear spots at the interfaces of the drive shaft/rolling element, rolling element/piston, and piston/piston bore. During the pumping event only rolling motion takes place between the piston and the rolling element. As the pump output changes at all times, so does the contact point, whereby statistically the entire inner and outer surfaces of the rolling element will participate in force transfer, resulting in a lower number of load cycles at any particular spot.
- Higher volumetric efficiency due to minimized participating low pressure dead volume, reduced leakage due to maximized sealing lands length, lower number of leaking interfaces and overall shorter pumping duration, as well as increased pumping chamber rigidity.
- Higher mechanical efficiency. Low friction at the rolling interface combined with shorter piston overhang result in reduced overall friction loses.
- Lower heat generation resulting in reduced heat rejection (cooler fuel).
- Lower part count and less complex machining resulting in higher reliability and lower costs. Overall smaller and lighter pump.

Easier inlet metering control because of absence of charging competition, typical for pumps with overlapping charging events.

Minimized number of low as well as high pressure sealing interfaces.

Overall lower number of pumping cycles during the life of the pump.

Absence of return springs (a dynamically highly stressed components) and required installation space.

DESCRIPTION OF THE PREFERRED EMBODIMENT

Figure 1:
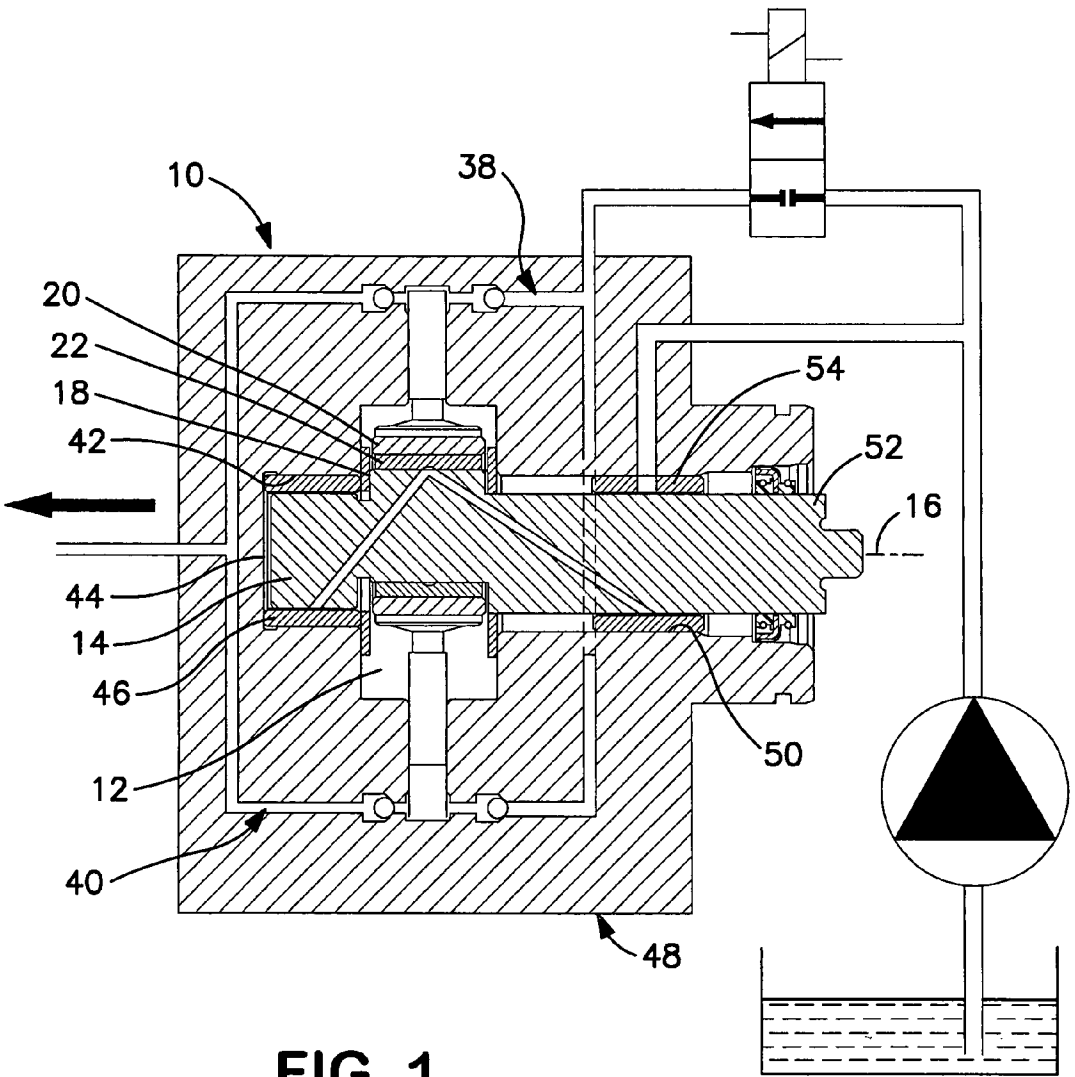
FIG. 1 is a schematic longitudinal section view of a two-piston pump according to a basic aspect of the present invention.
Figure 2:
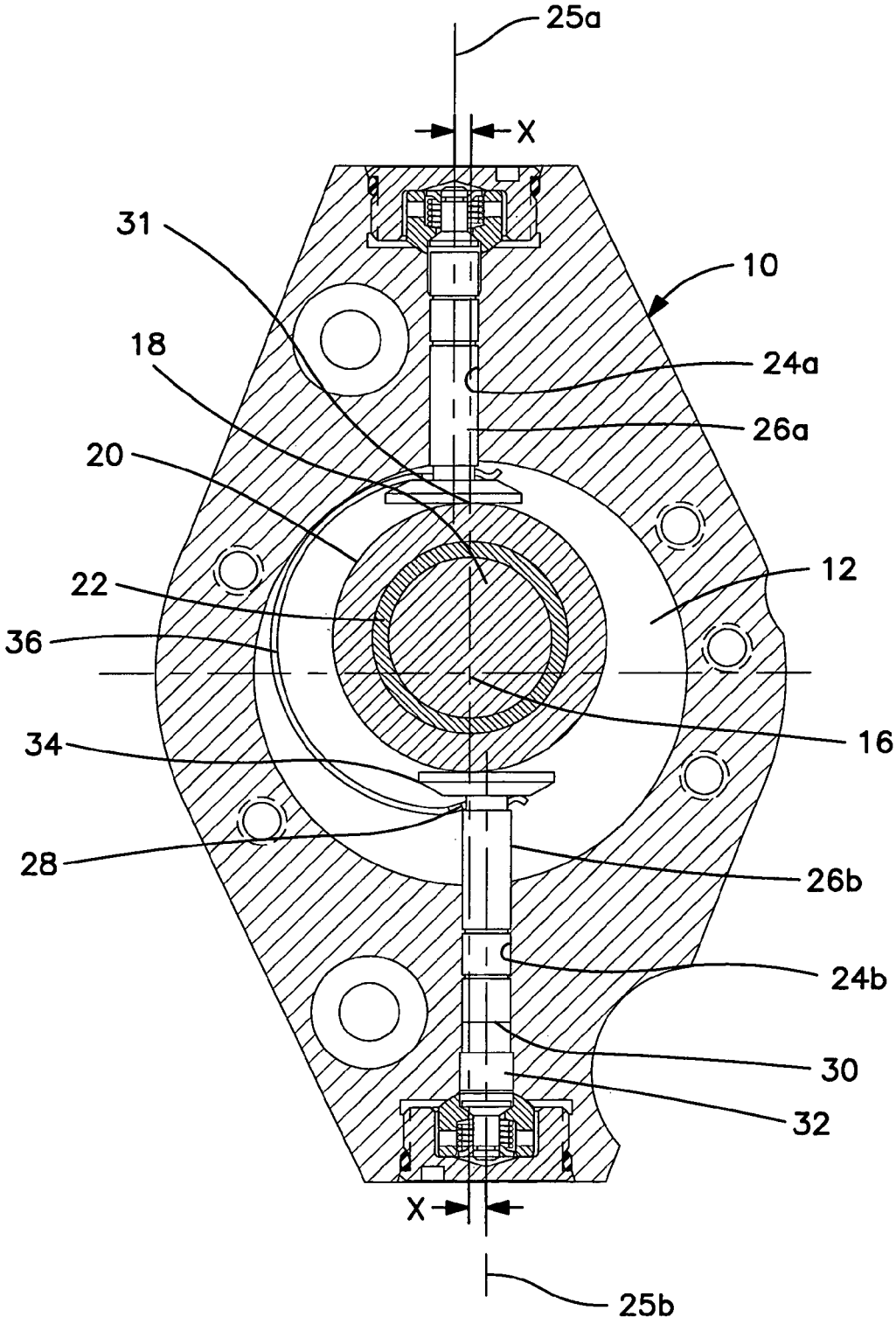
FIG. 2 is a schematic cross section view taken through the cavity of the hydraulic head shown in FIG. 1.

FIGS. 1 and 2 show a high pressure radial piston fuel pump comprising an hydraulic head (10) defining a central cavity (12) for receiving a rotatable drive shaft (14) longitudinally disposed along a drive axis (16) passing through the cavity. A cylindrical drive member (18) is rigidly carried by and offset from the drive shaft for eccentric rotation in the cavity about the drive axis as the drive shaft rotates. A substantially cylindrical piston actuation ring (20) is annularly mounted around the drive member. Bearing means (22), such as a needle bearing, is interposed between the drive member and the actuation ring, whereby the actuating ring is supported for free rotation about the drive member.

Two piston bores 24*a*, 24*b* extend in the head to the cavity 12, each piston bore having a centerline 25*a*, 25*b* that intersects the actuation ring but is offset (X) from the drive axis 16 as viewed along the drive axis (i.e., in section perpendicular to the drive axis). A piston 26*a*, 26*b* is situated respectively in each piston bore for free reciprocation and rotation therein. The pistons have an actuated end 28 in the cavity and a pumping end 30 remote from the cavity, wherein the pumping end cooperates with the piston bore to define a pumping chamber 32. A piston shoe 34 rigidly extends from the actuated end of each piston, and has an actuation surface for maintaining contact with the actuation ring 20 during rotation of the drive shaft.

Means are provide for biasing each piston toward the cavity. This is preferably a semi-rigid yoke (36) arranged between the shoes to dynamically coordinate (and thus assure) the retraction of one piston with the actuation of the other piston, according to a desmodromic effect. This also avoids backlash impact at low loads. The desmodromic yoke is not absolutely necessary for practicing the broad aspects of the invention, in that dedicated return springs could be used for each piston (at extra cost and mass) or such biasing means could in some instances be eliminated (as will be described below with respect to FIG. 10).

A feed fuel valve train (38) is provided in the head for each pumping chamber, for delivering charging fuel through an inlet passage in the head at a feed pressure to the pumping chamber. Similarly, a high pressure valve train (40) is provided in the head for each pumping chamber, for delivering pumped fuel to a discharge passage in the head at a high pressure from the pumping chamber. Thus, during one complete rotation of the drive shaft, each pumping chamber undergoes two phases of operation. In a charging or inlet phase, the associated piston is retracted toward the cavity by the yoke, thereby increasing the volume of the pumping chamber to accommodate an inlet quantity of fuel from the inlet valve train. In the discharging or pumping phase, the associated piston is actuated away from the cavity by the actuation ring, thereby decreasing the volume of the pumping chamber and pressurizing the quantity of fuel for discharge through the discharge valve train.

The hydraulic head has a shaft mounting bore (42) coaxial with the drive shaft axis, for receiving one end (44) of the drive shaft, and bearing means (46) for rotationally supporting this end of the drive shaft. A removable mounting plate (48) is attached to the hydraulic head, and has a shaft mounting throughbore (50) for receiving the other end (52) of the drive shaft while exposing this other end for engagement with a source of rotational power. A suitable bearing (54) is provided in the mounting plate for rotationally supporting the driven end of the drive shaft. The mounting plate can also have passages connected to the low pressure feed pump, for supplying a lubricating flow of fuel to the shaft bearings and to the bearing between the eccentric drive member and the actuating ring.

A significant feature of the rolling relationship between the pistons and actuation ring, is that, although the actuating ring will always rotate (roll) around the drive member in the opposite direction to the rotation of the drive shaft, such rotation will be random, thereby avoiding concentrated wear at one location, and also assuring that lubricating fuel will quickly be replenished at any location where metal-to metal contact has occurred. Furthermore, the offsets of the piston bores from the drive shaft axis, minimizes piston side loading.

Figure 3:
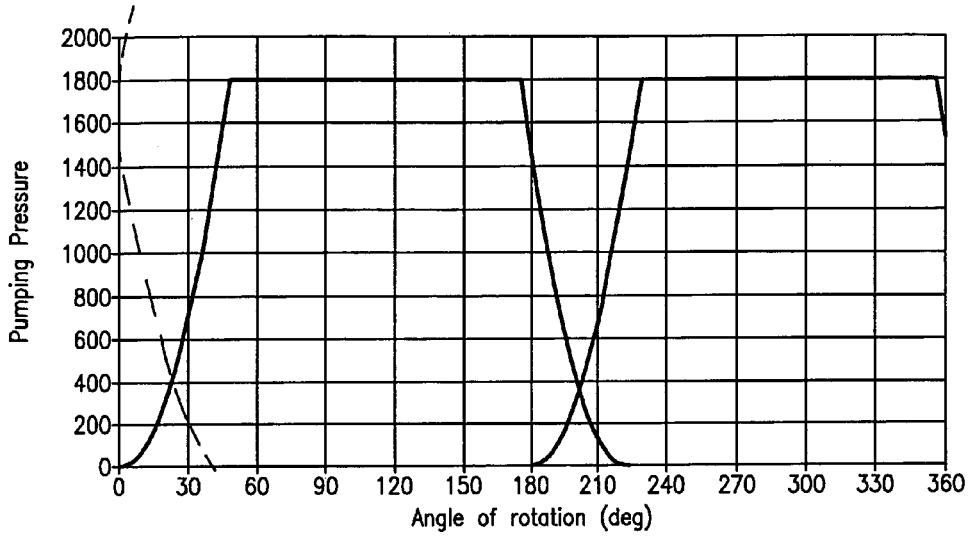
FIG. 3 is a graphic representation of the pumping pressure vs. angle of drive shaft rotation associated with the two piston pump of FIG. 1.

FIG. 3 is a graphic representation of the pumping pressure vs. angle of drive shaft rotation associated with the two piston pump of FIG. 1, running at a common rail pressure of 1800 bar and a pump speed of 1000 rpm, without inlet metering. This represents a cold start condition, which occurs at only a small fraction of the total time the engine operates. The actuated ends of the pistons have a rolling interaction with the actuating ring unless both pistons are pumping simultaneously as can occur briefly during cold start, whereupon a sliding interaction will be present. FIG. 3 shows that over a small included angle of drive shaft rotation (about 30–40 degrees) an overlapping pumping condition can exist, but the maximum pumping pressure during this overlap is less than 400 bar, which condition does not give rise to worrisome sliding friction.

Figure 4:
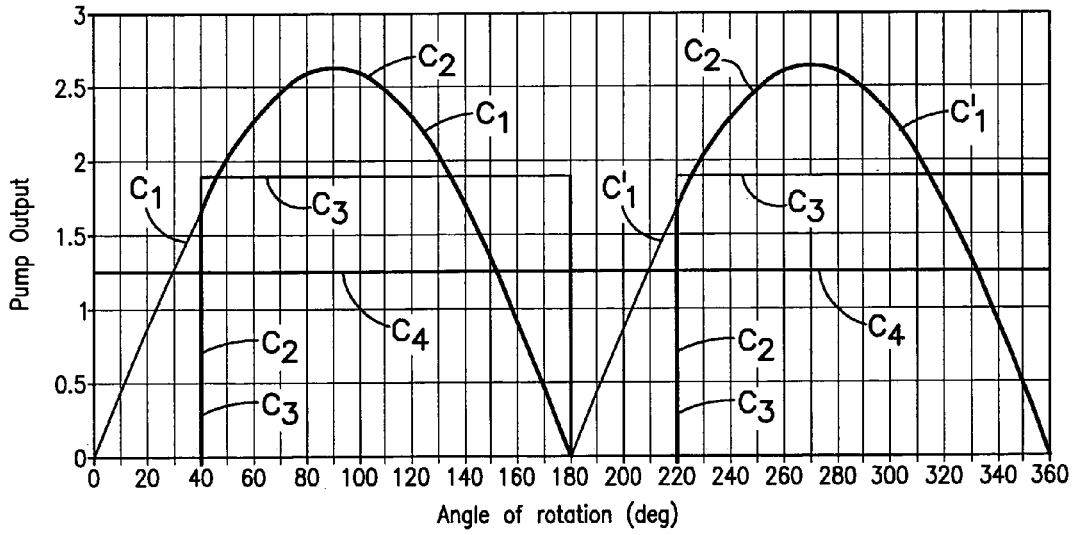
FIG. 4 is a graphic representation of the pump output vs. angle of drive shaft rotation for the pump of FIG. 1, at rated power and 1800 bar rail pressure, with inlet metering.

FIG. 4 is a graphic representation of the pump output vs. angle of drive-shaft rotation for the pump of FIG. 1, at rated power and 1800 bar rail pressure, with inlet metering. The displacements of sequential pistons are indicated by $C_1$, and $C_1'$, the regulated delivery is indicated by $C_2$, and the average rate during pumping is indicated by $C_3$, and the overall average pumping rate is indicated by $C_4$. This shows that the high pressure in each pumping chamber during successive pumping events is well separated during rated power conditions.

Figure 5:
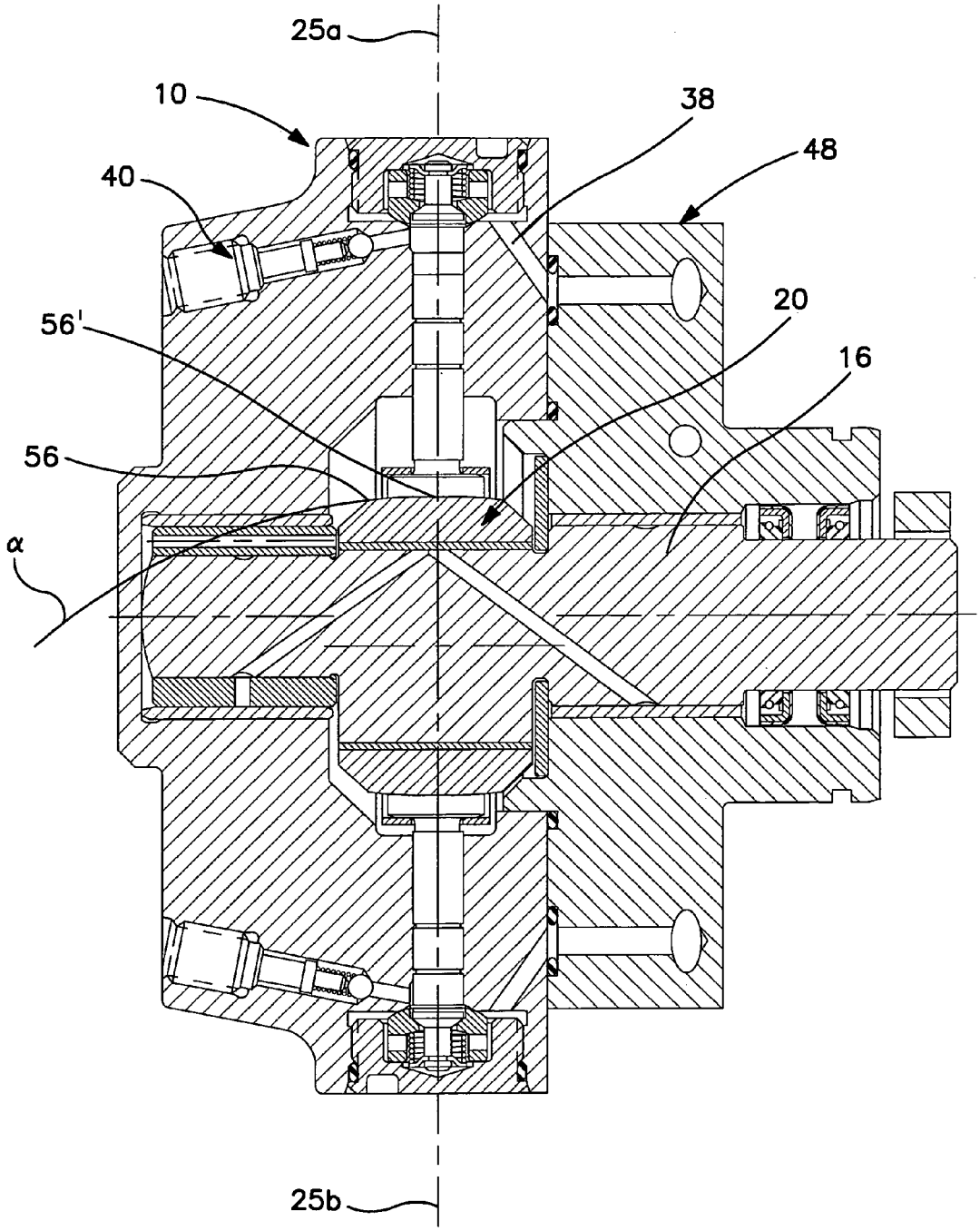
FIG. 5 is a longitudinal section view of the head of FIG. 1, with the additional features of a barrel shaped actuation ring with the center of the crown in the same plane as the centerlines of the piston bores, as viewed perpendicularly to the drive shaft axis.

FIG. 5 shows a variation in which the actuating ring 20 has an outer surface 56 that is somewhat barrel shaped. The curvature $\alpha$ rises and falls in the direction of the drive shaft axis and the center 56' of the crown radius always remains in a plane defined by the imaginary axes 25*a*, 25*b* of both pumping chambers.

This radius of curvature is quite large, e.g., on the order of about 3 feet. Even with random or systematic variations in the nominal parallelism between the centerline of the drive shaft and the rotation axis of the actuating ring and in the nominal relationship between the piston centerlines and the rotation axis of the actuating ring arising during operation, the crowning results in minimum piston side loading as the pumping force input point moves only insignificantly, following the eccentric during the pumping event. However this force input always rides in the same section of the piston head. Thus, the piston centerline is maintained in coaxial relation with the piston bore.

Figure 6:
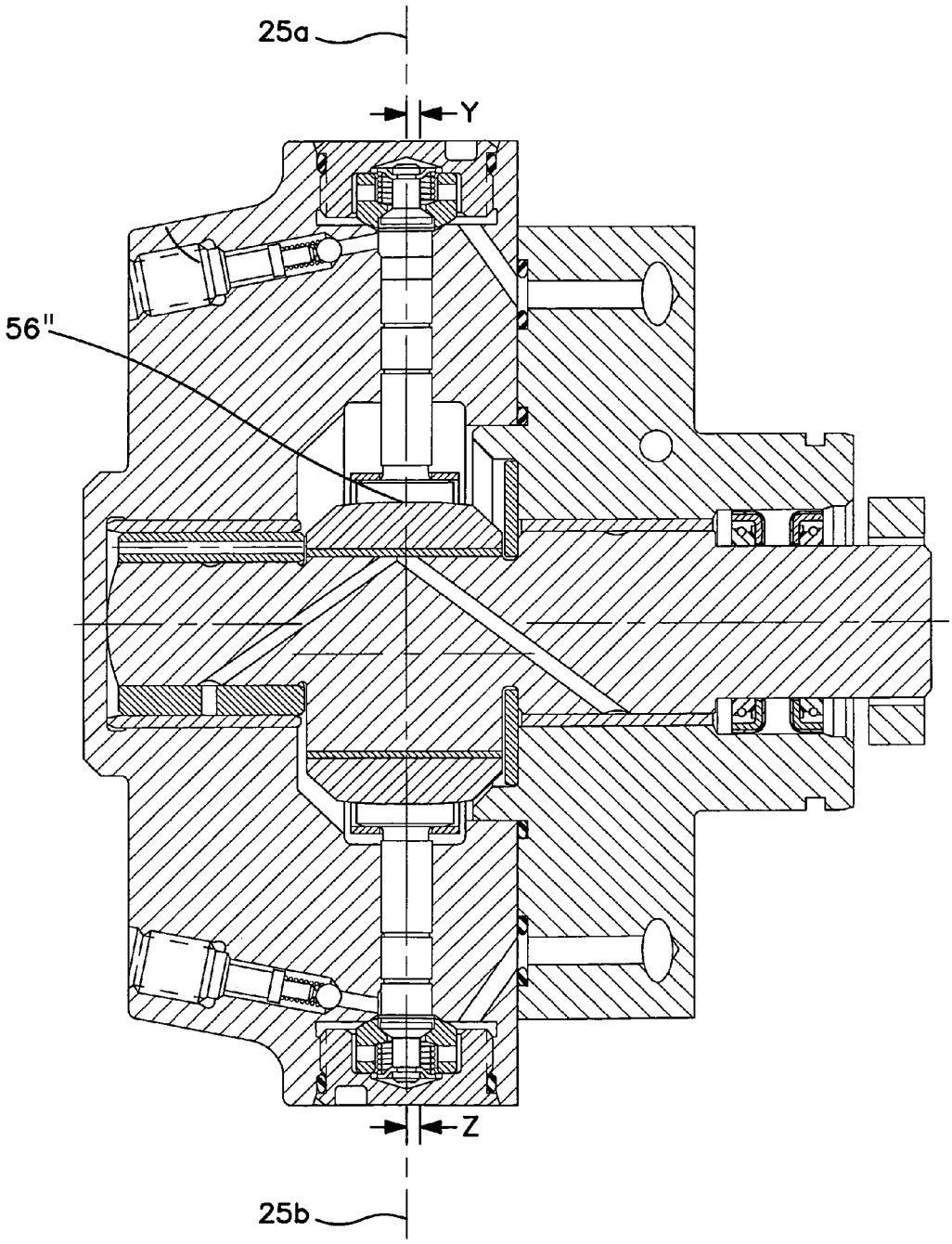
FIG. 6 is a view similar to FIG. 5, but with the centerlines of the piston bores offset from the center of the crown, as viewed perpendicularly to the drive shaft axis.

FIG. 6 shows two alternative configurations. First the piston bore centerlines (although shown to be co planar) could instead be parallel to each other but offset from each other as generally indicated at (Y). Second, whether or not offset Y is present, the high point or the center 56" of the curvature radius of the crown can (as shown) lie in a plane parallel to but offset (Z) from the centerlines 25*a*, 25*b* of the pumping piston bores, as viewed in longitudinal section perpendicularly to the drive axis. This embodiment increases piston side loading by a very small amount, but it will force the piston to rotate instead of slide during overlapping pumping events, reducing by that the cumulative number of load cycles at any given point on the shoes and the actuating ring.

Figure 8:
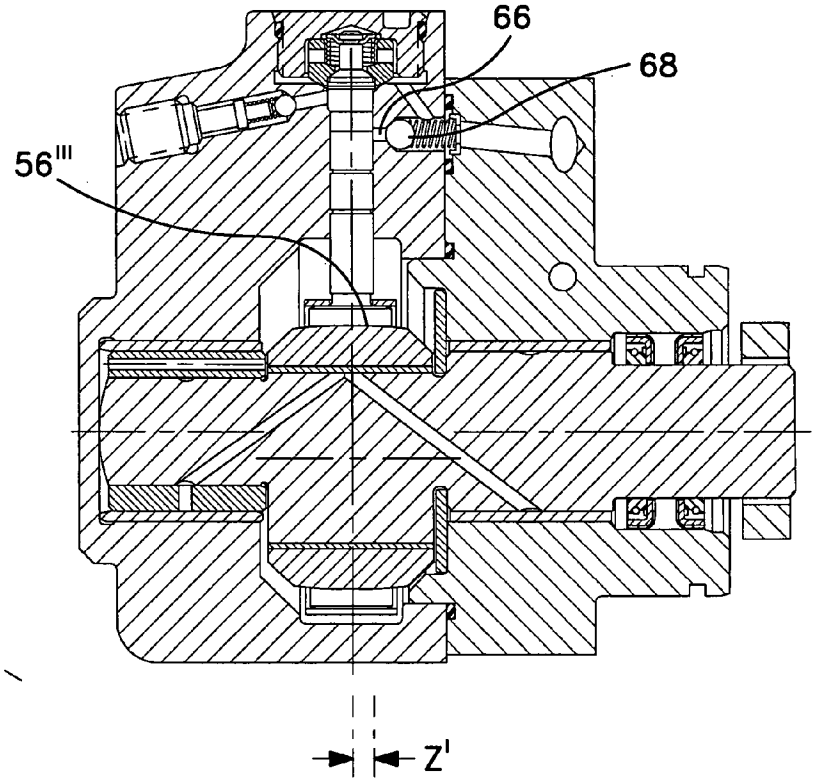
FIG. 8 is a section view through the hydraulic head of FIG. 7, including a pre-spill port with check valve for each pumping chamber.
Figure 7:
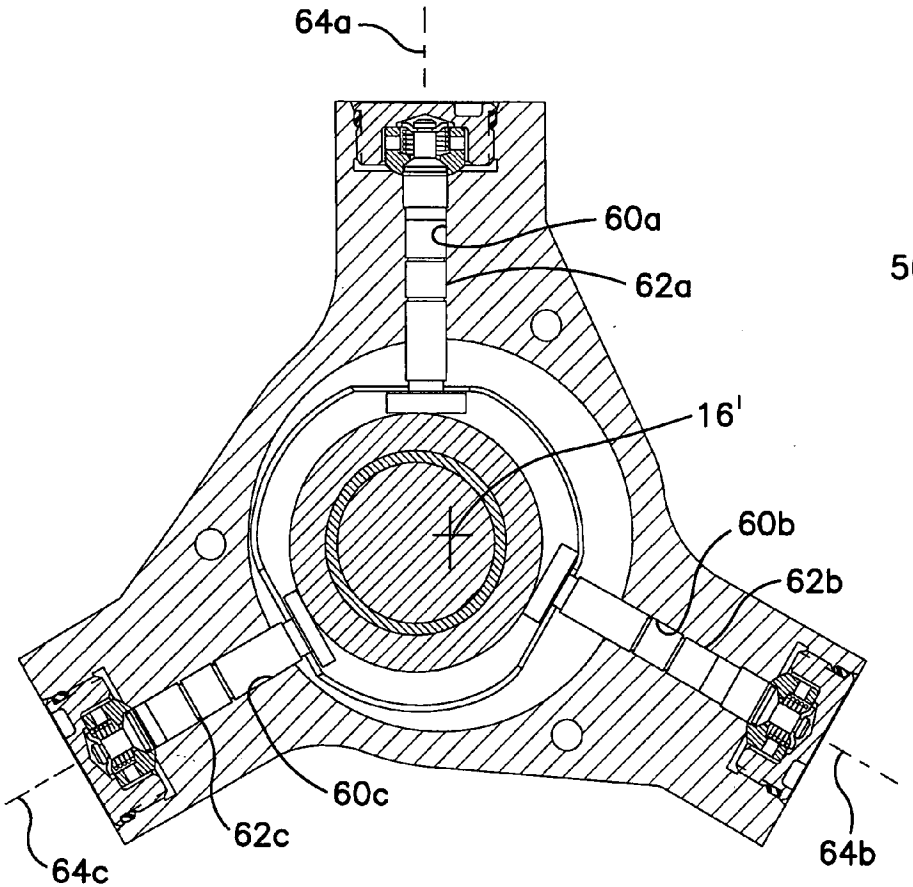
FIG. 7 is a cross sectional view through the cavity of a hydraulic head for a three piston pumping configuration according to the invention.

FIGS. 7 and 8 show the invention as embodied in a three-piston pump, with drive shaft axis indicated at 16', the piston bores indicated by 60*a*, 60*b*, and 60*c* and the pistons indicted by 62*a*, 62*b*, and 62*c*. In order to avoid simultaneous pumping of two chambers, which would lead to high force sliding at the roller/piston head interface, a fixed pre-spill port (66), delays the earliest start of pumping, resulting in separated pumping events. In essence, the discharge phase of the pumping chambers occur sequentially as distinct pumping events and each pumping chamber is fluidly connected to a pre-spill port for delaying the discharge of high pressure fuel through the discharge passage associated with a given pumping chamber, until the discharge of high pressure fuel through the discharge passage associated with the pumping chamber of the preceding pumping event has been completed. Because of the shortened pumping duration for each of three, rather than only two pumping events, the output increase is only about 20% over the two piston pump with the same eccentricity and piston diameter, but the three lower rate pumping events per revolution, reduce rail pressure pulsations and also offer more flexibility in injection event—pumping event synchronization.

By optionally adding a check valve 68 to the pre-spill port, inlet metering output control can be performed through the same port. The check valve in the pre-spill channel insures pumping event separation and at the same time it prevents back filling by vacuum generated by the retracting piston. Piston rotation induced by the off-center contact point is beneficial with or without pre-spilling, because it constantly changes not only the contact point between the piston and roller, but also between the piston and its bore, thereby reducing the tendency for scuffing.

The three piston pump can also incorporate the configuration wherein the center 56'" of the curvature radius of the crown lies in a plane parallel to but offset z' from the centerlines 64*a*, 64*b*, 64*c* of the pumping piston bores, as viewed perpendicularly to the drive axis. During the time when more than one piston is pumping (100% of maximum possible output), instead of sliding, one or both piston are allowed to rotate, protecting by that the piston roller interface from premature damage.

Figure 9:
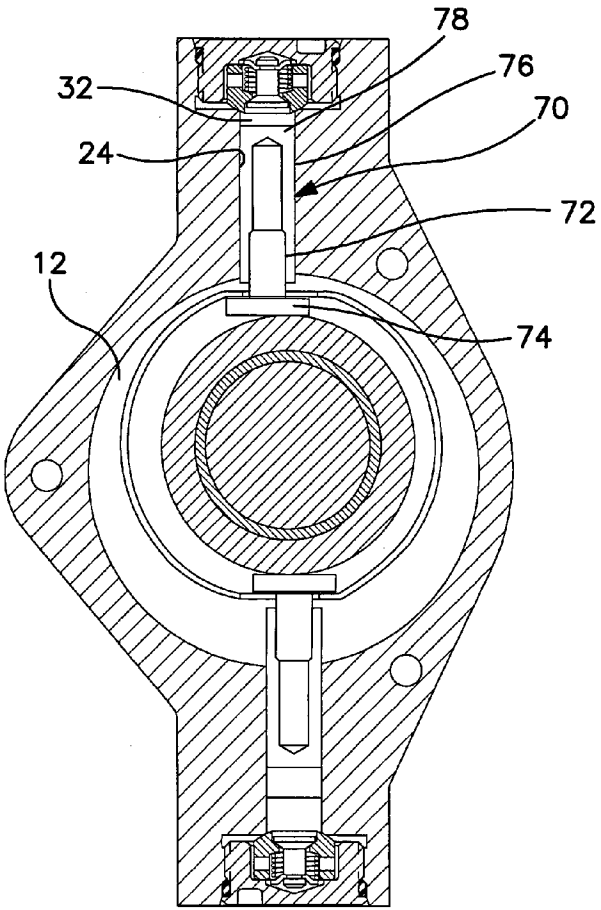
FIG. 9 is a schematic cross section of a two piston pump with a first alternative piston design.

FIG. 9 shows alternative, simplified pumping pistons 70 in bores 24, wherein each piston is a composite having a stem 72 situated in the pumping bore with integral shoe 74 situated in the cavity, and a substantially cylindrical sleeve 76 loosely surrounding the stem and presenting a closed end 78 to the pumping chamber 32.

Figure 10:
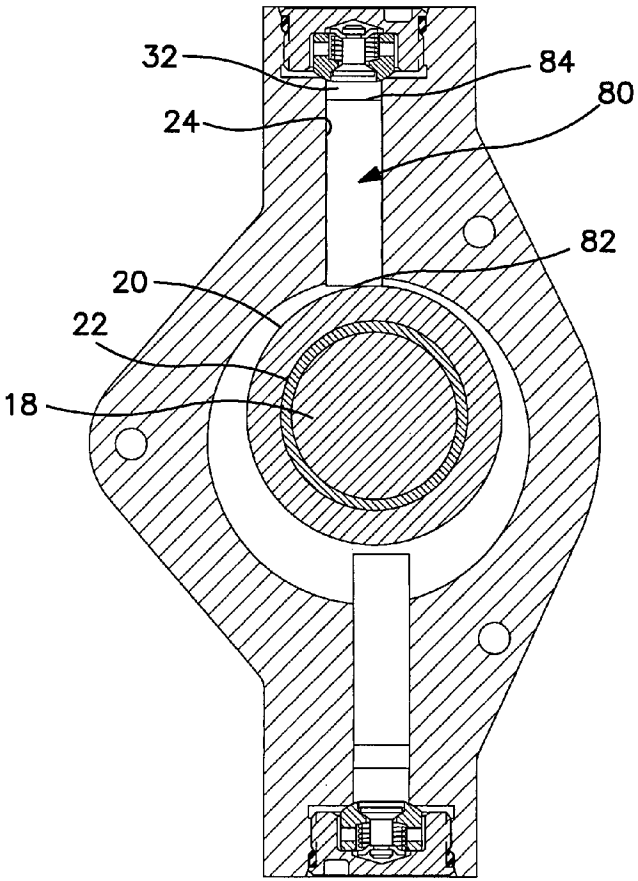
FIG. 10 is a schematic cross section of a two piston pump with a second alternative piston design.

FIG. 10 shows another piston embodiment, wherein each piston consists of a solid cylinder 80 of low mass material, such as a ceramic, and has an actuated end (82) in the cavity and a pumping end (84) remote from the cavity. The pumping end cooperates with the piston bore to define the pumping chamber (32) and the actuated end maintains contact with the actuation ring (20) during rotation of the drive shaft. This embodiment can operate without the energizing ring, because the vacuum associated with charging is sufficient to retract the piston during the charging phase of operation.

Output control of the pump can employ the same methods used with similar positive displacement pumps, such as inlet metering, pre-metering, pre-spilling, after-spilling or a combination.

The invention claimed is:

1. A high pressure radial piston fuel pump comprising:

an hydraulic head defining a central cavity for receiving a rotatable drive shaft longitudinally disposed along a drive axis passing through the cavity;

a cylindrical drive member rigidly carried by and offset from the drive shaft for eccentric rotation in the cavity about the drive axis as the drive shaft rotates;

a substantially cylindrical piston actuation ring annularly mounted around the drive member;

bearing means between the drive member and the actuation ring, whereby the actuating ring is supported for freely rotating about the drive member;

at least two piston bores extending in the housing to the cavity, each piston bore having a centerline that intersects the actuation ring but is offset (x) from the drive axis as viewed along the drive axis;

a piston situated respectively in each piston bore for free reciprocation therein, said piston having an actuated end in the cavity and a pumping end remote from the cavity, wherein the pumping end cooperates with the piston bore to define a pumping chamber;

a piston shoe rigidly extending from the actuated end of each piston, and having an actuation surface for maintaining contact with the actuation ring during rotation of the drive shaft;

means for biasing each piston toward the cavity;

a feed fuel valve train for delivering charging fuel through an inlet passage in the head at a feed pressure to the pumping chamber;

a high pressure valve train for delivering pumped fuel to a discharge passage in the head at a high pressure from the pumping chamber;

whereby during one complete rotation of the drive shaft, each pumping chamber undergoes a charging phase wherein the associated piston is retracted toward the cavity by the means for biasing, thereby increasing the volume of the pumping chamber to accommodate an inlet quantity of fuel from the inlet valve train, and a discharging phase wherein said associated piston is actuated away from the cavity by the actuation ring, thereby decreasing the volume of the pumping chamber and pressurizing the quantity of fuel for discharge through said discharge valve train; wherein the hydraulic head has a shaft mounting bore coaxial with the drive shaft axis, for receiving one end of the drive shaft, and bearing means for rotationally supporting said one end of the drive shaft;

a removable mounting plate is attached to the hydraulic head, said mounting plate having a shaft mounting throughbore for receiving the other end of the drive shaft while exposing said other end for engagement with a source of rotational power, and bearing means for rotationally supporting said other end of the drive shaft; and the actuation ring has an outer surface that is crowned, having a curvature that rises and falls in the direction of the drive shaft axis.

2. The pump of claim 1, wherein the center of the crown radius is in a plane defined by the centerlines of the pumping bores.

3. The pump of claim 1, wherein the center of the crown radius lies in a plane parallel to but offset (z) from the pumping bore centerlines, as viewed perpendicularly to the drive axis.

4. The pump of claim 1, wherein the pump has only two piston bores and associated two pistons, each piston bore has a centerline that intersects the actuation ring but is offset (x) from the drive axis as viewed along the drive axis, and the piston bore centerlines are parallel to each other but offset (y) from each other as viewed perpendicularly to the drive axis.

5. The pump of claim 1, wherein the pump has only three equiangularly spaced apart piston bores and associated three pistons, and each piston bore has a centerline that intersects the actuation ring but is offset from the drive axis as viewed along the drive axis.

6. The pump of claim 5, wherein the discharge phase of the pumping chambers occur sequentially as distinct pumping events and each pumping chamber is fluidly connected to a pre-spill port for delaying the discharge of high pressure fuel through the discharge passage associated with a given pumping chamber, until the discharge of high pressure fuel through the discharge passage associated with the pumping chamber of the preceding pumping event has been completed.

7. The pump of claim 6, including a check valve in the pre-spill port.

8. The pump of claim 5, wherein the piston bore centerlines are offset from each other as viewed perpendicularly to the drive axis.

9. The pump of claim 5, wherein the center of the crown radius is in a plane defined by the centerlines of the pumping bores.

10. The pump of claim 5, wherein the center of the crown radius lies in a plane parallel to but offset from the pumping bore centerlines, as viewed perpendicularly to the drive axis.

11. The pump of claim 1, wherein each piston is a composite having a stem situated in the pumping bore with integral shoe situated in the cavity, and a substantially cylindrical sleeve loosely surrounding the stem and presenting a closed end to the pumping chamber.

12. The pump of claim 1, wherein the piston bore centerlines are parallel to each other but offset (y) from each other as viewed perpendicularly to the drive axis.

13. A high pressure radial piston fuel pump comprising:

an hydraulic head defining a central cavity for receiving a rotatable drive shaft longitudinally disposed along a drive axis passing through the cavity;

a cylindrical drive member rigidly carried by and offset from the drive shaft for eccentric rotation in the cavity about the drive axis as the drive shaft rotates;

a substantially cylindrical piston actuation ring annularly mounted around the drive member, said actuation ring having an outer surface that is crowned, having a curvature that rises and falls in the direction of the drive shaft axis;

bearing means between the drive member and the actuation ring, whereby the actuating ring is supported for freely rotating about the drive member;

at least two piston bores extending in the housing to the cavity, each piston bore having a centerline that intersects the actuation ring;

a piston situated respectively in each piston bore for free reciprocation and rotation therein, said piston having an actuated end in the cavity and a pumping end remote from the cavity, wherein the pumping end cooperates with the piston bore to define a pumping chamber;

a piston shoe rigidly extending from the actuated end of each piston, and having an actuation surface for maintaining contact with the actuation ring during rotation of the drive shaft;

means for biasing each piston toward the cavity;

a feed fuel valve train for delivering charging fuel through an inlet passage in the head at a feed pressure to the pumping chamber;

a high pressure valve train for delivering pumped fuel to a discharge passage in the head at a high pressure from the pumping chamber;

whereby during one complete rotation of the drive shaft, each pumping chamber undergoes a charging phase wherein the associated piston is retracted toward the cavity by the means for biasing, thereby increasing the volume of the pumping chamber to accommodate an inlet quantity of fuel from the inlet valve train, and a discharging phase wherein said associated piston is actuated away from the cavity by the actuation ring, thereby decreasing the volume of the pumping chamber and pressurizing the quantity of fuel for discharge through said discharge valve train.

14. The pump of claim 13, wherein the center of the crown radius is in a plane defined by the centerlines of the pumping bores.

15. The pump of claim 14, wherein the piston bore centerlines are parallel to each other but offset (y) from each other as viewed perpendicularly to the drive axis.

16. The pump of claim 13, wherein the center of the crown radius lies in a plane parallel to but offset from the pumping bore centerlines, as viewed perpendicularly to the drive axis.

17. The pump of claim 16, where the piston bore centerlines are parallel to each other but offset (y) from each other as viewed perpendicularly to the drive axis.

18. The pump of claim 13, wherein each piston bore has a centerline that intersects the actuation ring but is offset (x) from the drive axis as viewed along the drive axis.

19. A high pressure radial piston fuel pump comprising:

an hydraulic head defining a central cavity for receiving a rotatable drive shaft longitudinally disposed along a drive axis passing through the cavity;

a cylindrical drive member rigidly carried by and offset from the drive shaft for eccentric rotation in the cavity about the drive axis as the drive shaft rotates;

a substantially cylindrical piston actuation ring annularly mounted around the drive member and having an outer surface that is crowned with a curvature that rises and falls in the direction of the drive shaft axis;

bearing means between the drive member and the actuation ring, whereby the actuating ring is supported for freely rotating about the drive member;

at least two piston bores extending in the housing to the cavity, each piston bore having a centerline that intersects the actuation ring but is offset (x) from the drive axis as viewed along the drive axis;

a piston situated respectively in each piston bore, each piston consisting of a solid cylinder of low mass material, such a ceramic, and having an actuated end in the cavity and a pumping end remote from the cavity, wherein the pumping end cooperates with the piston bore to define a pumping chamber and the actuated end maintains contact with the actuation ring during rotation of the drive shaft;

a feed fuel valve train for delivering charging fuel through an inlet passage in the head at a feed pressure to the pumping chamber;

a high pressure valve train for delivering pumped fuel to a discharge passage in the head at a high pressure from the pumping chamber;

whereby during one complete rotation of the drive shaft, each pumping chamber undergoes a charging phase wherein the associated piston is retracts toward the cavity, thereby increasing the volume of the pumping chamber to accommodate an inlet quantity of fuel from the inlet valve train, and a discharging phase wherein said associated piston is actuated away from the cavity by the actuation ring, thereby decreasing the volume of the pumping chamber and pressurizing the quantity of fuel for discharge through said discharge valve train.

* * * * *

UNITED STATES PATENT AND TRADEMARK OFFICE

CERTIFICATE OF CORRECTION

PATENT NO. : 7,134,846 B2
APPLICATION NO. : 10/857313
DATED : November 14, 2006
INVENTOR(S) : Djordjevic It is certified that error appears in the above-identified patent and that said Letters Patent is hereby corrected as shown below:

Column 10, line 19, after “piston” delete “is”.

Signed and Sealed this

Twenty-sixth Day of June, 2007

JON W. DUDAS
*Director of the United States Patent and Trademark Office*